US007155852B2

(12) United States Patent
Vogler

(10) Patent No.: US 7,155,852 B2
(45) Date of Patent: Jan. 2, 2007

(54) MULTI-DIRECTIONAL PLACARD DISPLAY HOLDER

(76) Inventor: Michael N. Vogler, 49 Miranda Court, Thornhill, Ontario (CA)

( * ) Notice: Subject to any disclaimer, the term of this patent is extended or adjusted under 35 U.S.C. 154(b) by 283 days.

(21) Appl. No.: 10/820,871

(22) Filed: Apr. 9, 2004

(65) Prior Publication Data

US 2005/0223610 A1 Oct. 13, 2005

(51) Int. Cl.
*G09F 3/20* (2006.01)

(52) U.S. Cl. ..... 40/658; 40/611.12; 40/642.02; 40/651; D20/43

(58) Field of Classification Search ..... 40/124.4, 40/611.06, 611.12, 642.02, 651, 658, 764; 211/119.003, 59.2; 248/441.1, 505, 501; D20/43

See application file for complete search history.

(56) References Cited

U.S. PATENT DOCUMENTS 5,826,359 A * 10/1998 Thalenfeld et al. ..... 40/642.01
6,082,687 A * 7/2000 Kump et al. ..... 248/220.41
6,189,247 B1 * 2/2001 Gebka ..... 40/642.01
D453,534 S * 2/2002 Kosir ..... D20/43
2002/0029505 A1 * 3/2002 Faneuf ..... 40/658

OTHER PUBLICATIONS

2003 Yellow Pages Catalog, pp. 44,45,84,92,94,97,98.*

* cited by examiner

*Primary Examiner*—Gary C. Hoge
(74) *Attorney, Agent, or Firm*—William J. Daniel

(57) ABSTRACT

A holder for displaying a thin advertising placard on a fixture exhibiting merchandise for sale, has an elongated shank shaped at one end for detachable fixation to the fixture, and carrying at the other end a three-dimensional head for holding the placard. The head has at least one, preferably more, substantially linear slot extending across a portion of its periphery and inwardly into its interior for receiving a marginal portion of the placard. Each such slot on its interior is shaped for gripping the placard portion.

19 Claims, 2 Drawing Sheets

MULTI-DIRECTIONAL PLACARD DISPLAY HOLDER

FIELD OF THE INVENTION

This invention relates to a display holder for placards, signs, tickets and the like used especially for merchandizing or marketing purposes, such as the display to the purchasing public at the point of sale of goods and products of advertising matter, pricing data, sales "specials", "discounts", price reductions, and similar information for attracting the attention of potential purchasers, and is directed more particularly to a "multi-directional" display holder that is adapted to display the placard, etc. in a variety of different orientations relative to line of sight of a viewing customer, e.g. up or down vertical, left or right vertical, forward vertical, or horizontal up or down, (and any tilted variation therebetween) and can be quickly attached to and removed from a product display.

BACKGROUND OF THE INVENTION

It is common for a variety of goods, articles, products and so on offered for sale in stores, shops and the like to be stocked, often in quantity, on/in shelves, racks, cases, bins, etc. for inspection and selection by consumers. The display of pricing information at the location of each product, i.e. at the point of sale, is ordinarily necessary, or at the very least desirable, as price tends to be a major factor in product choice. Moreover, certain products are often promoted or emphasized for sale at certain times, e.g. as "specials", "two for the price of one", "discounts" and like "buyer-appealing" phrases, by means of advertisement and/or price reductions and the display to the potential purchaser of the desired advertising information or reduction in price can be critical to the success of such promotion.

While small pricing stickers may be adhered to individual products and/or somewhat larger pricing tickets or tags can be and are mounted, e.g. seated in a shallow channel along the front edge of the shelf or rack, as is the usual practice, in proximity to each group of products, such display "media" are too small to draw the attention of a prospective purchaser and the amount of information that can be provided on tickets or tags is limited, being usually restricted to identification and price alone, making the exhibition of appealing advertising material to entice an undecided customer almost out of the question. In any event, this kind of display is the same on many if not all of the products at each shelf or rack and lacks the distinctive character required for significant impact on the perception of a prospective purchaser in that it does not differentiate from regular pricing tickets or stand out from the remainder of the merchandise in the area.

One common approach to this problem of effective advertising displays is in the form of a quadrangular frame having mutually facing channels around at least three of the frame side into which a display placard can be inserted and retained. Examples of this approach can be found and U.S. Pat. Nos. 1,996,616, 2,581,742, and 2,981,018. Similar holders for smaller cards such as plastic credit cards or driver's licenses are shown in U.S. Pat. Nos. 2,629,952 and 4,674,628. An improved and simplified frame of this general type invented by me can be found in U.S. Pat. No. 5,442,873, issued on Aug. 22, 1995.

While such quadrangular frames are quite useful, they are subject to certain unavoidable limitations or disadvantages. First, since advertising placards typically vary in size depending upon the circumstances of their use, i.e. different levels of a sale promotion may call for placards of different sizes to vary the extent of customer impact or certain articles may require the display of different amounts of advertising information, an "inventory" of such frames of different sizes must be kept on hand with the attendant complications of storage, handling etc. Even if placard size can be standardized to a single size, the frames are relatively bulky which introduces a problem of storage and, given their fragility by reason of the minimization of their marginal cross-section so as to maximize the interior display area, are susceptible to breakage and replacement from time to time.

Consequently, there continues to be a need in the merchandizing field for an advertising placard display support that is free of these kinds of drawbacks.

OBJECTS OF THE INVENTION

One object of the invention is a advertising placard display support or holder that is adapted to support the placard in a variety of orientations and (within reasonable limits) is inherently free of limitations upon the size of placard that can be accommodated and, thus, can be fairly characterized as having much broader application than common existing placard holders.

Another object is a multi-orientation display placard support which provides a reasonably secure retention of the placard in its display position while obscuring only a very small region of the placard display area.

Yet another object is a placard card support of compact and sturdy design greatly simplifying storage and handling with lessened risk of breakage and which can be placed in and removed from operative position quickly and easily.

Still another object is a placard display support having the features set forth above which can be manufactured at very modest expense without sacrifice in durability.

BRIEF DESCRIPTION OF THE ILLUSTRATIVE DRAWINGS

Two of the numerous possible embodiments incorporating the main features of the invention appear in the accompanying drawings which may be briefly described as follows.

DETAILED DESCRIPTION OF EXEMPLARY EMBODIMENTS

Reduced to its simplest form, the placard display holder of the invention utilizes three components which are joined together in generally linear relationship and may be produced as an integral unit, as is preferred, or as separate pieces that can be readily assembled together in that relationship. For convenience, these components will be described separately.

Preliminarily, it should perhaps be noted that the display holder of this invention is designed for utilization with signs or placards (the latter term being used herein in a broad sense) made from flat sheet-form material having a density and/or weight often referred to as cardboard, posterboard, paperboard or even high weight paper, that is what might be called "stiffly resilient". That is to say, the sheet material of any reasonable size suitable for "on the spot" advertising, say, up to about 8–9 in. by 11–14 in. or perhaps even larger in some cases, while flexible in the sense of being capable of undergoing bending or flexing under applied force, is sufficiently stiff as to return to about its original flat condition when the bending force is removed, assuming, of course, that it has not been permanently deformed or distorted as by creasing or stretching. Thus, such sheet material might be called "self-supporting" in that when supported by a fairly small marginal (edge) portion, it will when oriented vertically remain substantially up-standing and when oriented horizontally will remain substantially so, that is, with at most only a slight slant from its normal planar condition. An appropriate thickness for the placard material is in the approximate range of 10 pt to 30 pt.

Figure 1:
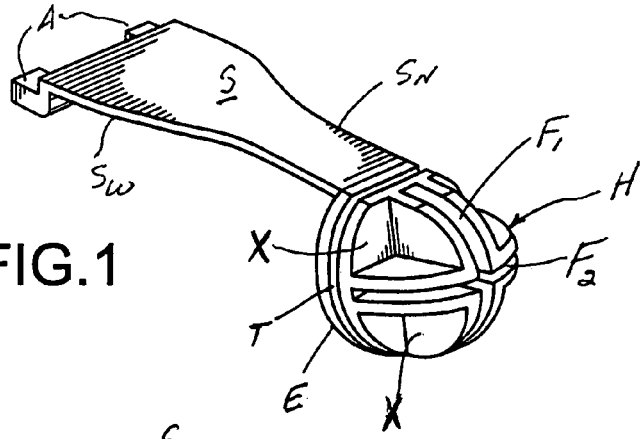
FIG. 1 is a left side perspective view of a first embodiment of the holder of this invention.

The first component constitutes one end of the present holder and serves to releasably receive and support the display placard in several of different orientations. In order to fulfil its function and provide a plurality of placard-receiving slots, this component must be a three-dimensional solid and, for descriptive purposes, it is herein referred to as a "head", designated H. Generally speaking, head H has a bulbous configuration but its actual shape can vary considerably. A preferred contour, as illustrated in FIG. 1, is roughly semi-spherical, i.e. rounded at its front end and flat at its rear, but other shapes, especially solid geometrical shapes, could serve equally well, such as square, rectangular, cylindrical, trapezoidal, ellipsoidal and so on. Indeed, any shape would, in principle, be suitable that can accept at least one, and preferably two, internally directed slots, designated F1 and F2, along a portion of its front end and adjacent its rear another slot, designated T, directed generally transversely to the first and preferably extending radially inwardly around the entire circumference of the head without, of course, penetrating completely through the head body which would divide the head in to two parts.

As noted, the presence of two front end slots F1 and f2 is the preferred arrangement with the two slots intersecting one another. For symmetries' sake, the line or axis of intersection is at the mid-points of the two slots and this axis is generally parallel to, and, most preferably, coincident with, the axis of the head, e.g. in the case shown, the axis of the semi-sphere. As will be explained in greater detail later on, exact parallelism between the slot axis of intersection and the head axis is not required, some deviation from exactitude of, say, a few degrees up to as much as 20–25° being tolerable and, in fact, advantageous for certain circumstances (and the term "generally parallel" is intended to being intended to cover this variation). It is possible that an asymmetrical intersection of the two front-end slots, i.e. displaced from a mid-point, could be employed but this would be an aberration for which no rationale can be discerned at this time and for most head shapes would tend to undesirably shorten one of those slots.

In the simplest construction, as shown, the bottom wall or floor B of the slots is straight and perpendicular to the head axis; a curved floor is conceivable but would add the length (axial dimension) of the head. The depth of the slot or slots is not critical provided it is sufficient to receive a significant marginal portion of the placard, that is a portion of the placard that when gripped is capable of stably supporting the placard as a whole without undue flexing from the normal flat condition of the placard. Obviously, the extent of that portion, both lengthwise and depthwise, can be different with different sizes of placard since the placard size will influence, along with other factors such as the stiffness of the placard material, the weight/thickness of the placard and similar properties that affect the bending stress that must be resisted by the grip of the slot. For most purposes, a depth of about 0.5–1 in. is adequate. There is no hard requirement that the two slots have the same depth although this is usual and no reason for changing their depths is apparent.

Where the minimum of a single front end slot is present, it is best located in the head so as extend vertically when the holder is in its operative (use) position so that a placard inserted therein would likewise be disposed vertically and thus be visible from either side. The presence of a second front end slot is not indispensable because a placard placed in the latter would lie horizontally and hence would be visible only from above and below. But there will likely be situations where visibility of the placard from above or below would be desirable and for maximum scope of utility the provision of a second front end slot is preferred, as shown. There can be more than two front end slots intersecting on the same axis if desired but extra slots rarely serve a real need.

As can be seen in FIG. 1, the material in the regions of the head other than necessary to form the walls of the slots serves no functional purpose and can be dispensed with and removed from the head, as at X, with a consequential saving in material. The result (for a two slot embodiment) is a cruciform-appearing head, when viewed from the front. However, this "skeletonizing" of the head does not alter its general contour which remains, for instance, in the case of the embodiment of FIG. 1 a generally semi-spherical configuration and the same applies to the other solid shapes specified above.

Figure 2:
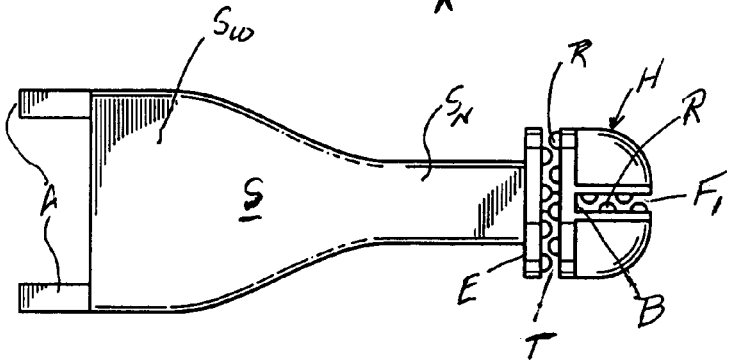
FIG. 2 is a top plan view of the embodiment of FIG. 1.

As already suggested, and is in any case inherently obvious, the front end slots do not pass entirely through the length of the head and the resultant rear sector is provided with a differently-directed slot T, i.e. that lies generally transversely of the head axis and thereby opens in a direction laterally of the head. The transverse slot could have a chordal configuration on one side of the head, and would, in that event, be matched by one or more similar chordal slots on other sides of the head. However, the optimum arrangement affording maximum orientation options is for the transverse slot to extend around the entire circumference of the head rear section to define an annular opening, leaving a central circular solid area, barely visible in FIG. 2 at the center of slot F2. This central area extends between and joins an interior solid (transverse) wall constituting the inner wall of the transverse slot (and including the floor for the front end walls) and a solid (transverse) wall which constitutes the other wall of that slot and can form the end wall E of the head. The annular radius of the transverse slot corresponds to the depth of the front end slots and is subject to similar constraints.

Whatever the configuration of the front end and transverse slots, the opposed side faces of the slots are provided with sheet gripping means. The sheet gripping means takes the form of arrays of interiorly projecting mutually opposed spaced parallel ribs R disposed in alternating or staggered association with their tips in roughly co-planar or slightly interdigitating or overlapping relation (the term "substantially coplanar" being intended to describe generally this relationship). The width of the slots, i.e. the distance between the side walls thereof, needs to be sufficient for reception of the placard therein and a width several times the thickness of the placard is advisable, e.g. about 3 to 6 times, although this is not a hard and fast multiple and could be more, especially for thicker placard sheets.

Figure 3:
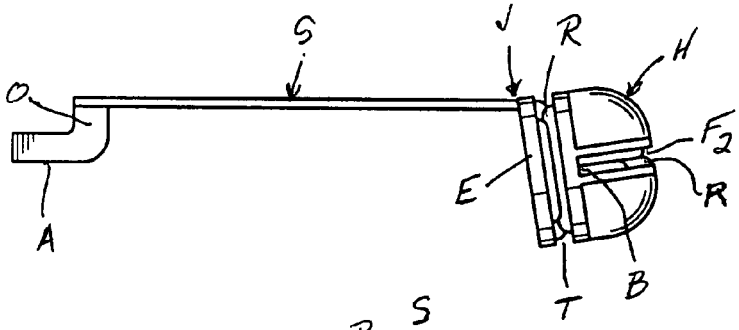
FIG. 3 is a left side elevation view of the FIG. 1 embodiment.
Figure 4:
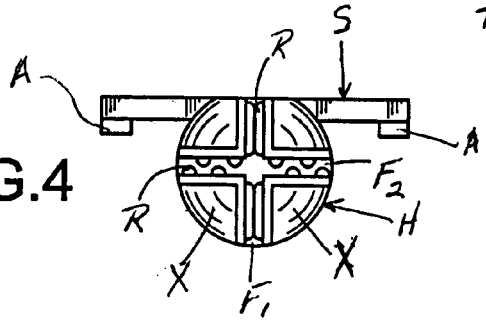
FIG. 4 is a front end view of the FIG. 1 embodiment.

The ribs in height (i.e. projection from the slot walls) are about half the slot width in order to protrude about half-way across the slot to bring the tips (free ends) of the opposing arrays into roughly co-planar or just barely interdigitating or overlapping relation. That is, the tips of the ribs from both side walls of a slot lie in substantially the same or a common plane. The ribs are narrow in width (lateral dimension) compared to their length such as to create enough ribs in the slot to securely engage between the opposed arrays the placard margin, i.e. at least three ribs per array and preferably at least four or more, dependent on the slot depth which can be influenced by the head dimensions. The space separating adjacent ribs of the respective arrays, i.e. the interval therebetween, should be about as large, or possibly slightly larger, as the width (lateral dimension) of the individual ribs. The ribs have a rounded cross-section at least at their tips (or in entirety if their height is short, as seen especially in FIG. 2) in order to promote smooth passage therearound of the placard edge and create adequate clearance with the tips of the ribs of the opposed array for the placard thickness. For the same reason, at their outer ends proximate to the head periphery, the ribs are rounded or sloping to create an approximately V-shaped entrance visible in FIG. 3. The ribs in the opposed arrays for each slot are parallel and are shown with a lengthwise direction generally perpendicular or parallel to the head axis, dependent upon the slot in question, but ribs having their length inclined to the head axis would likely serve as well. Easy entrance of a placard into a ribbed slot is aided if the lengthwise direction of the ribs therein is parallel to the general direction in which the placard edge enters the slot so that the placard edge initially encounters rounded ends of the ribs. However, if the rib length is perpendicular to the placard loading direction and excessive resistance should occur as the placard edge passes into the slot, this can be remedied by rotating (tilting) the placard in its own plane about 45° or so to bring the edge into contact with the rounded rib ends and then sliding the placard further into the slot and finally returning the placard in the proper display orientation.

Thus, the edge of a placard upon being inserted into a ribbed slot is forced by the non-resilience of the rib tips to take by bending a shallow sinuous curvature around the rib tips, the resilience of the placard permitting it to flex enough to assume that curvature with the application of small force within its own plane. When the placard margin is fully in place within a slot and the insertion force removed, the placard is then held in place its resilience, urging its return to its normal flat state, together with the frictional resistance of the rib tips against the placard side surface.

If in a particular head construction excessive resistance should be encountered in inserting a specific choice of placard into a slot having parallel side walls, the configuration can be modified (not shown) to impart a slight flair to the walls from inside to outside so that the side walls are slightly farther apart at their outer ends then in the interior. This results in a resistance to placard insertion which is less at the beginning of the insertion and then increases as the insertion proceeds and the placard advances into the slot. The flair need not extend along the entire depth of a slot but can be limited to an outer region to form a "mouth" that eases the entrance of the placard edge into the slot and between the ribs. The consequence of adoption of this variation is a slight deviation from a true common place of the rib tips in the flared region and the phrase "substantially a common plane" is intended to encompass this small difference.

Obviously, the tips or rounded ends of the ribs constitute their "working" part, i.e. the part having actual engagement with the placard surface. Thus, provided the slot width (side wall separation) satisfies the minimum requirements discussed above, an increase in slot width (and of rib height) is of little or no consequence except to extend the head length.

The second component of the holder is an elongated stem or shank which is connected to the rear end of the head and extends away therefrom, i.e. opposite to the front end slot opening direction. The function of this component is to maintain the head the desired distance away from the merchandising fixture where the placard is to be mounted to thereby increase the visibility of the placard to a passing prospective customer. As this function is essentially passive, wide latitude is available for the length and configuration of the shank. Fundamentally, its length is determined by practical considerations, namely, what length obtains a satisfactory "exposure" of the placard without overly interfering with freedom of customer movement relative to the fixture. Often, a few inches, say, about three to five inches, represents a good compromise but other lengths may be indicated by other factors.

In the embodiments of the drawings, the shank has the form of an elongated relatively narrow thin flat plate joined at one end to the top of the rear end of the head, as at J. For a given material of construction, the thickness of the plate is selected is impart a suitable stiffness thereto that is sufficient to support the head and placard weight. Absolute rigidity is not necessary, although not ruled out as a possible choice; moderate flexibility is usually better to accommodate to unforeseen shock but not so much that the shank would bend under the weight of the placard. A flat plate has the advantage of minimizing the profile of the shank and thus distracting from the "eye appeal" of the display. The width of the shank, again, is optional which permits the width of the shank to be adapted to the needs of the final component. Shank cross-sectional contours other than a thin rectangle could certainly be utilized equally well, such as square, circular, oval, or even cruciform, the latter offering enhanced resistance to bending.

In general, the lengthwise axis of the shank is parallel to the head axis, although, as noted above, exact parallelism is not a prerequisite. Some display shelves or racks have a forward and downward slope, utilizing gravitational force to "feed" articles thereon to the front for easy access by customers, and the illustrated embodiment is designed for association with such a shelf. Hence, as apparent from FIG. 3, the head is joined to the shank at an angle deviating upwardly from axially parallel by about 10–15°, permitting the head axis to assume a horizontal position while the shank follows the inclination of the fixture to which it is attached. Naturally, the angle of deviation from axially parallel can be changed to match the slope of a given shelf and shelf inclination can be partially accommodated in other ways, including simply giving a placard vertically oriented placard in a front end slot a tilt when placed within the head.

As illustrated, the shank front end is connected to the top of the rear end of the head, as mentioned above, and the latter is flattened from its otherwise rounded curvature for a better fit with the chosen shank configuration. The location and manner of the connection between head and shank can be widely modified especially for other shank and head configurations.

The third and final component of the present holder is a means connected to the shank end opposite to the head for attaching or anchoring the holder to cooperate with the structure of whatever kind of merchandising fixture is employed by a given merchant, store or the like and is referred to herein generally as an "anchoring means", designated A. As is common knowledge, stores exhibit their merchandise in a variety of ways, dependent to some extent on the nature of the particular articles/products that are for sale but also on a particular preference of the merchant. Without intending to set forth an exhaustive list, these can include shelves, racks, frameworks, stands, bins, cases, crate, chests and so on, all of which for purposes of this description are referred to collectively as "merchandising fixtures". Accordingly, the anchoring means of the invention can differ widely to suit the requirements of a particular type of fixture and this can be a significant factor in the selection of the shank shape.

In the initial embodiment of FIG. 1, the fixture, not shown, is equipped with two laterally spaced apart small apertures and, accordingly, the anchoring means in this embodiment is formed by correspondingly spaced tongues which mate with the apertures to penetrate the same and attach the holder to this specific type of display. Because the separation of the tongues in this instance exceeds the selected size (diameter) of the head, the flat plate shank is expanded laterally from a relatively narrow front section Sn joined to the rear of the head to a rear section of increased width Sw which carries the tongues at its corners. As shown, the tongues are offset a short distance downwardly from the lower surface of the plate, as at 0, to thereby create a vertical shoulder that is adapted to bear against the (not shown) face of the fixture directly above the slots and in that way impart enhanced positional stability to the holder. The number and shape of the tongues could be altered in other ways for the same purpose.

Figure 6:
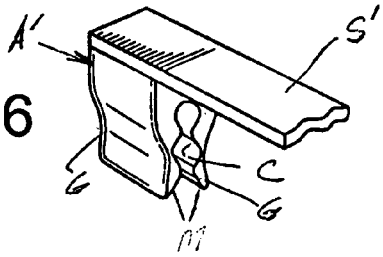
FIG. 6 is a fragmentary perspective view similar to FIG. 1 showing in relevant part a second embodiment of the invention.
Figure 5A:
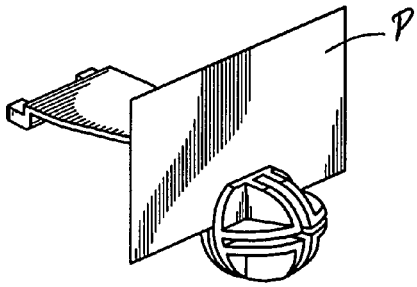
FIGS. 5A–5F are perspective views similar to FIG. 1 illustrating the several different possible orientations for a display placard mounted on the holder of FIG. 1.
Figure 5B:
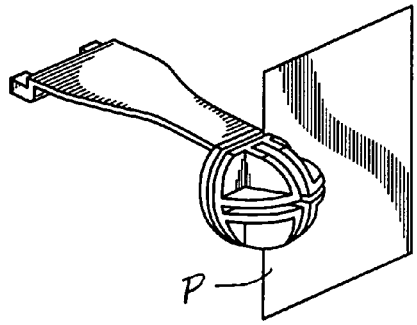
Figure 5C:
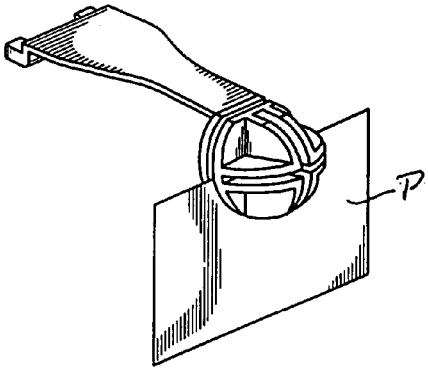
Figure 5D:
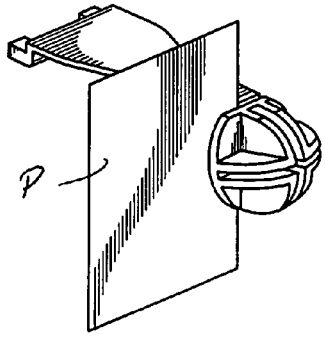
Figure 5E:
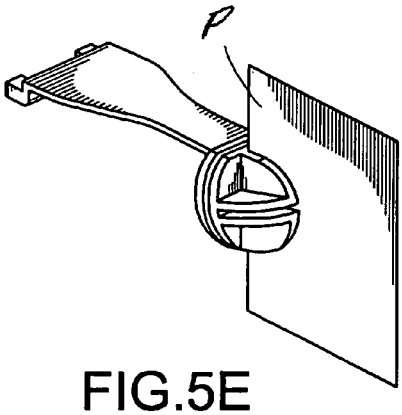
Figure 5F:
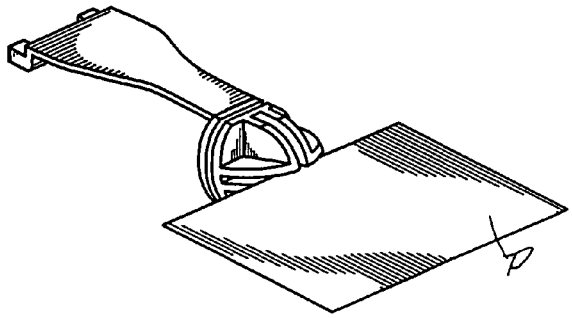

FIG. 6 shows a second embodiment of the present holder incorporating a different type of anchoring means A' which is adapted for use with a fixture which is in the form of a wire rack or includes a hook or peg or post adjacent its front. To accommodate to this kind of fixture structure, the anchoring means at the free end of the shank is formed by a pair of downwardly projecting resilient fingers or tongues G having internal opposed concavities C which are sized to the diameter of a slim cylindrical element (not shown) of the particular fixture and are adapted to yieldably separate when forced onto the element and then as the element seats in the concavities to spring back to clampingly grip the element. The axial dimension (breadth) of the resilient fingers is made great enough for the fingers to have a firm grasp of the element and support the shank and head (with placard) without pivoting or swinging on the fixture element. The contouring of the resilient fingers (including the concavities) can be designed to permit repeated flexing without cracking or breaking, while still achieving a strong gripping force there between, and preferably includes outwardly flared ends, as at M, to cam the fingers apart as the element is forced there between.

In as much as the lateral separation of the resilient fingers of the second embodiment is small, there is no need for expansion of the rear end of the shank and thus, the shank A' can have a uniform width throughout its length, as shown.

The two forms of anchoring means illustrated are by no means the only ways the present holder could be attached to a store fixture. Indeed, one can imagine a considerable variety of other types of anchoring means that could be used instead. Rather than a clamping engagement using the natural resilience of elongated fingers, resort could be had to mechanical clamping force applied between two parts by a threaded screw or a coiled spring similar to ordinary hardware clamps. Or the shank plate could be disposed vertically with vertically separated tongues at its free end to engage with vertical slots in the fixture or with a curled free end to resiliently wrap around a vertical fixture element and so on. Hence, the term "anchoring means" is intended to have generic scope.

FIGS. 5A–5F show the six principal different orientations that the placard, designated P, can be given with the holder of the invention, disregarding possible variations of these six.

The holder of this invention can be constructed and manufactured in various ways. Preferably, a moldable plastic is selected as the construction material, such as high impact polystyrene to give just a single example. A one-piece (unitary) construction is preferred, as can be obtained by injection molding or the like, but molding of separate parts, e.g. one for each component, can be employed, the parts being designed to connect together readily for easy assembly. The latter would offer the advantage of multiple interchangeable components that might be offset by some added complications in terms of inventory and handling.

During the course of the preceding description, a number of possible alternative or modifications have been noted, It will be appreciated, however, that other additional changes will be within the skill of those familiar with the art. Hence, the invention should be interpreted as limited only as required by the appended claims.

That which is claimed is:

1. A holder for displaying a generally stiffly flexible, thin advertising placard in association with a merchandizing fixture exhibiting such merchandize for sale, which comprises an elongated shank, at one end of said shank anchoring means adapted for detachable affixation to said fixture, and at the other end a three-dimensional head for reception of said placard, said head having at least one substantially linear slot defined between opposite faces extending across a first portion of the head periphery and inwardly into the head interior, said slot having a thickness exceeding the thickness of said placard and a depth sufficient to receive a marginal portion of said placard, the opposite faces of said slot each having an array of slightly spaced apart parallel non-resilient ribs projecting there from towards the opposite face in alternating relation with the ribs of the opposite face to form opposed arrays, the ribs of said arrays terminating in tips, the tips of the ribs of the opposed arrays for each slot lying in substantially the same plane and having a generally rounded cross-section to permit flexing insertion therein of said marginal placard portion while asserting firm frictional engagement therewith.

2. The holder of claim 1 wherein said head includes a further substantially linear interiorly directed slot in a second portion of its periphery which is displaced from said first peripheral portion toward the anchoring means to bodily separate said at least one slot and said further slot, the plane of said further slot extending in a generally different direction from the plane of each said at least one slot, the opposite faces of said further slot having opposed arrays of ribs projecting there from similar to the ribs of said at least one slot, whereby the orientation of said placard on said holder can be selected between generally angularly differing positions.

3. The holder of claim 1 wherein said head has the configuration of a generally semi-spherical body having its axis generally parallel to the shank axis.

4. The holder of claim 1 wherein said at least one slot in said head is in an end portion of the head periphery and opens in a direction generally away from said anchoring means.

5. The holder of claim 4 wherein said head has a dimension generally parallel to the lengthwise axis of said shank which is greater than the depth of said at least one slot in the head end portion and includes another linear slot in the head periphery in a region of the head periphery displaced from said at least one slot in said head end portion toward the anchoring means to bodily displace said other slot from said at least one slot toward said anchoring means, the plane of said other slot extending generally transversely to the shank axis, and the opposite faces of said other slot having opposed arrays of ribs projecting there from similar to the ribs of said at least one slot, thereby providing a choice in the orientation of said placard on said holder between positions generally parallel and generally transverse to the shank axis.

6. The holder of claim 4 wherein said head end portion has a plurality of said slots which intersect at substantially their midpoints in angular relation to provide a choice in the orientation of said placard between angularly differing positions.

7. The holder of claim 6 wherein there are two of said slots in said end portion which intersect at an angle of about 90° to one another.

8. The holder of claim 7 wherein the axis of intersection of said two slots is generally parallel to the longitudinal axis of said shank.

9. The holder of claim 2 wherein said further slot in the displaced portion of said head periphery extends around the entire periphery of the head partially into the interior therefor with a depth sufficient to receive the marginal placard portion without passing completely through the head, allowing for varying perimetal positions of the placard In its transverse orientation.

10. The holder of claim 9 wherein said head has the configuration of a generally semi-spherical body having its axis generally parallel to the shank axis and said at least one slot is are in generally the apex region of said semi-spherical body while said further slot is in generally the circumferential region thereof and extends around the entire circumference of said body to form a generally annular slot with an annular radius sufficient to receive said marginal portion of said placard, whereby the generally transverse orientation of said placard can be varied around the entire circumference of said semi-spherical body.

11. The holder of claim 1 wherein said shank is in the form of an elongated generally flat plate connected at one end to said head.

12. The holder of claim 11 wherein said plate end is connected to a top peripheral portion of said head.

13. The holder of claim 1 wherein said anchoring means is in the form of at least one tongue adapted to be engaged with a part of said merchandising fixture.

14. The holder of claim 1 wherein said anchoring means is in the form of resilient fingers projecting in spaced apart relation from said shank and adapted to clampingly engage a part of said merchandizing fixture there between.

15. A holder for displaying a generally stiffly flexible, thin advertising placard in association with a merchandizing fixture exhibiting such merchandize for sale, which comprises a three-dimensional head for holding said placard, extending away from one end of said head anchoring means for detachable affixation to said fixture, extending across the head end opposite said anchoring means a first substantially linear slot of a limited depth sufficient to receive a marginal portion of said placard, and a second generally linear slot extending across at least a portion of the head periphery into its interior generally transversely of said first slot to a depth sufficient to receive a marginal portion of said placard, said second slot being spaced bodily from the interior limit of said first slot and arranged in overlapping relation with an outer segment of said first slot, each slot being provided on its interior with placard-gripping means.

16. The holder of claim 15 wherein said head has at least one further slot extending across its end opposite said anchoring means to said limited depth, the planes of said first and further slots intersecting in generally X-shaped relation.

17. The holder of claim 15 wherein said head has a generally bulbous configuration.

18. The holder of claim 15 wherein said second slot extends around the entire periphery of said head into its interior without passing completely through said head whereby said second slot is generally ring-shaped to permit said placard to occupy varying positions around the circumference of the head.

19. The holder of claim 15 wherein each such slot is defined between opposed faces and the placard gripping means comprises on the opposed faces thereof arrays of slightly spaced apart parallel non-resilient ribs projecting there from towards the opposite face and terminating in tips of generally rounded cross-section, the ribs of the array on one face being arranged in alternating relation with the ribs of the array on the opposite face, the tips of the ribs of the opposed arrays for each slot lying in substantially the same plane to permit flexing insertion therein of said marginal placard portion while asserting firm frictional engagement therewith.

* * * * *